United States Patent [19]

Shrier

[11] Patent Number: 5,068,634

[45] Date of Patent: Nov. 26, 1991

[54] OVERVOLTAGE PROTECTION DEVICE AND MATERIAL

[75] Inventor: Karen P. Shrier, Half Moon Bay, Calif.

[73] Assignee: Electromer Corporation, Belmont, Calif.

[*] Notice: The portion of the term of this patent subsequent to Jan. 8, 2008 has been disclaimed.

[21] Appl. No.: 390,732

[22] Filed: Aug. 8, 1989

Related U.S. Application Data

[63] Continuation-in-part of Ser. No. 143,615, Jan. 11, 1988, Pat. No. 4,977,357.

[51] Int. Cl.[5] ..... H01C 7/10

[52] U.S. Cl. ..... 338/21; 338/20; 361/127; 252/512; 428/323

[58] Field of Search ..... 338/20, 21, 99, 100, 338/114, 208; 252/62.2, 62.3 R, 500, 512; 361/117, 126, 127; 428/323

[56] References Cited

U.S. PATENT DOCUMENTS 3,685,026 8/1972 Wakabayashi et al. ..... 338/20 X 4,551,268 11/1985 Eda et al. ..... 338/21 X 4,726,991 2/1988 Hyatt et al. ..... 338/21 X 4,795,998 1/1989 Dunbar et al. ..... 338/208 X

*Primary Examiner*—Marvin M. Lateef

*Attorney, Agent, or Firm*—Flehr, Hohbach, Test, Albritton & Herbert

[57] ABSTRACT

A material and device for electronic circuitry that provides protection from fast transient over-voltage pulses. The electroded device can additionally be tailored to provide electrostatic bleed. Conductive particles are uniformly dispersed in an insulating matrix or binder to provide material having non-linear resistance characteristics. The non-linear resistance characteristics of the material are determined by the inter-particle spacing within the binder as well as by the electrical properties of the insulating binder. By tailoring the separation between the conductive particles, thereby controlling quantum-mechanical tunneling, the electrical properties of the non-linear material can be varied over a wide range.

21 Claims, 4 Drawing Sheets

OVERVOLTAGE PROTECTION DEVICE AND MATERIAL

This application is a continuation-in-part of pending application Ser. No. 143,615 filed Jan. 11, 1988 entitled Overvoltage Protection Device And Material and now U.S. Pat. No. 4,977,357, issued Dec. 11, 1990.

SUMMARY OF THE INVENTION

The present invention relates to materials, and devices using said materials, which protect electronic circuits from repetitive transient electrical overstresses. In addition to providing over-voltage protection, these materials can also be tailored to provide both static bleed and over-voltage protection.

More particularly the materials have non-linear electrical resistance characteristics and can respond to repetitive electrical transients with nanosecond rise times, have low electrical capacitance, have the ability to handle substantial energy, and have electrical resistances in the range necessary to provide bleed off of static charges.

Still more particularly, the materials formulations and device geometries can be tailored to provide a range of on-state resistivities yielding clamping voltages ranging from fifty (50) volts to fifteen thousand (15,000) volts. The materials formulations can also be simultaneously tailored to provide off-state resistivities yielding static bleed resistances ranging from one hundred thousand ohms to ten meg-ohms or greater. If static bleed is not required by the final application the off-state resistance can be tailored to range from ten meg-ohms to one thousand meg-ohms or greater while still maintaining the desired on-state resistance for voltage clamping purposes.

In summary the materials described in this invention are comprised of conductive particles dispersed uniformly in an insulating matrix or binder. The maximum size of the particles is determined by the spacing between the electrodes. In the desired embodiment the electrode spacing should equal at least five particle diameters. For example, using electrode spacings of approximately one thousand microns, maximum particle size is approximately two hundred microns. Smaller particle sizes can also be used in this example. Inter-particle separation must be small enough to allow quantum mechanical tunneling to occur between adjacent conductive particles in response to incoming transient electrical over-voltages. In general, quantum mechanical tunneling is believed to occur for inter-particle separation in the range of 25 angstroms to 350 angstroms.

Even more particularly, the nature of the dispersed particles in a binder allows the advantage of making the present invention in virtually unlimited sizes, shapes, and geometries depending on the desired application. In the case of a polymer binder, for example, the material can be molded for applications at virtually all levels of electrical systems, including integrated circuit dies, discrete electronic devices, printed circuit boards, electronic equipment chassis, connectors, cable and interconnect wires, and antennas.

The nature of the dispersed particles in a binder allows the advantage of making the present invention in virtually unlimited sizes, shapes, and geometries depending on the desired application.

DETAILED DESCRIPTION OF THE INVENTION

Figure 1:
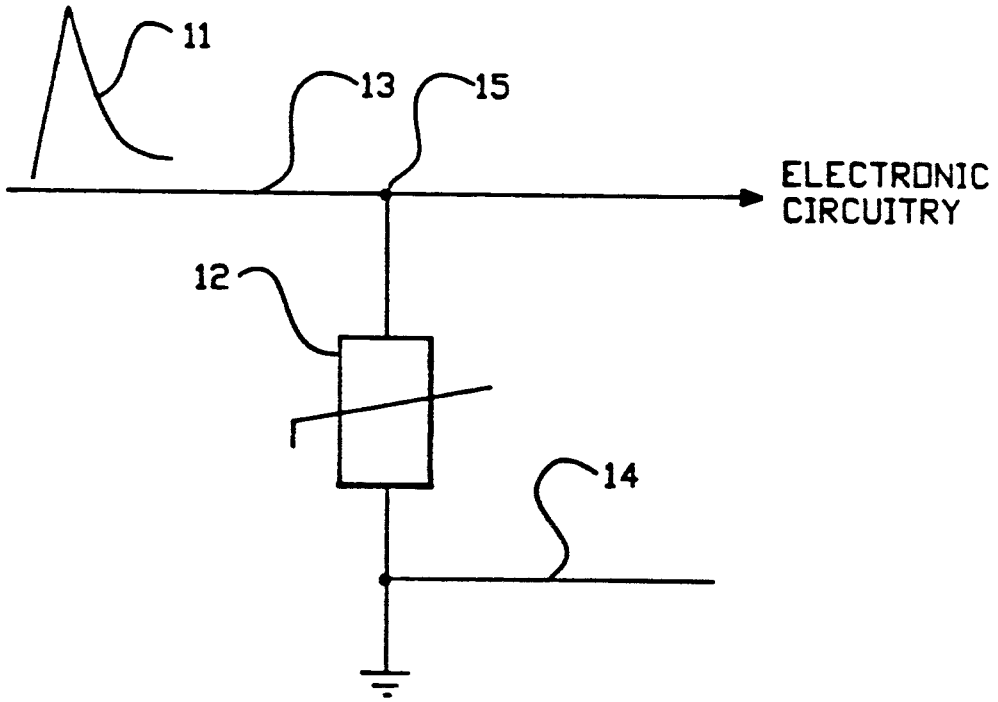
FIG. 1 is a typical electronic circuit application using devices of the present invention.

As shown in FIG. 1, devices made from the present invention provide protection of associated circuit components and circuitry against incoming transient over-voltage signals. The electrical circuitry 10 in FIG. 1 operate at voltages generally less than a specified value termed $V_1$ and can be damaged by incoming transient over-voltages of more than two or three times $V_1$. In FIG. 1 the transient over-voltage 11 is shown entering the system on electronic line 13. Such transient incoming voltages can result from lightning, EMP electromagnetic pulse, electrostatic discharge, and inductive power surges. Upon application of such transient over-voltages the non-linear device 12 switches from a high-resistance state to a low-resistance state thereby clamping the voltage at point 15 to a safe value and shunting excess electrical current from the incoming line 13 to the system ground 14.

The non-linear material is comprised of conductive particles that are uniformly dispersed in an insulating matrix or binder by using standard mixing techniques. The on-state resistance and off-state resistance of the material are determined by the inter-particle spacing within the binder as well as by the electrical properties of the insulating binder. The binder serves two roles electrically: first it provides a media for tailoring separation between conductive particles, thereby controlling quantum-mechanical tunneling, and second as an insulator it allows the electrical resistance of the homogeneous dispersion to be tailored. During normal operating conditions and within normal operating voltage ranges, with the non-linear material in the off-state, the resistance of the material is quite high, as will be described below. Two types of materials can be made using the present invention, with differing off-state resistance values. One type of material has an off-state resistance in the range required for bleed-off of electrostatic charge: an off-state resistance ranging from one hundred thousand ohms to ten meg-ohms or more. The second type of material has an off-state resistance in the range required for an insulator: an off-state resistance in the $10^9$ ohm region or higher. For both materials, and devices made therefrom, conduction in response to an over-voltage transient is primarily between closely adjacent conductive particles and results from quantum mechanical tunneling through the insulating binder material separating the particles. For both types of materials, and devices made therefrom, conduction in response to an over-voltage transient, or over-voltage condition, causes the material to operate in its on-state for the duration of the over-voltage situation.

Figure 2:
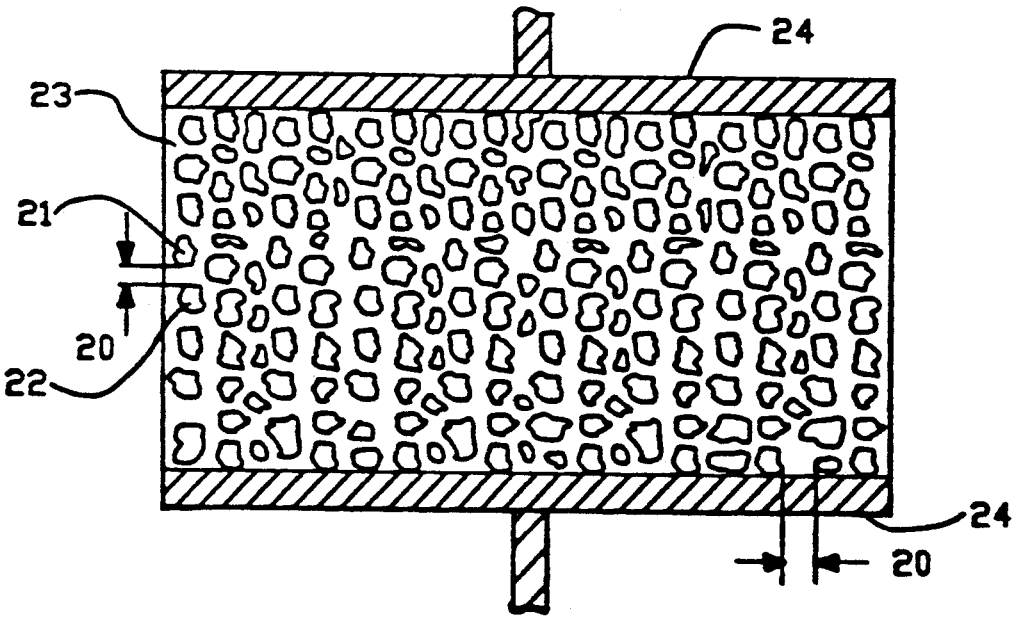
FIG. 2 is a magnified view of a cross-section of the non-linear material.

FIG. 2 illustrates schematically a two terminal device with inter-particle spacing 20 between conductive particles, and electrodes 24. The electrical potential barrier for electron conduction from particle 21 to particle 22 is determined by the separation distance 20 and the electrical properties of the insulating binder material 23. In the off-state this potential barrier is relatively high and results in a high electrical resistivity for the non-linear material. The specific value of the bulk resistivity can be tailored by adjusting the volume percent loading of the conductive particles in the binder, the particle size and shape, and the composition of the binder itself. For a well blended, homogeneous system, the volume percent loading of a particular size of particles determines the inter-particle spacing.

Application of a high electrical voltage to the non-linear material dramatically reduces the potential barrier to inter-particle conduction and results in greatly increased current flow through the material via quantum-mechanical tunneling. This low electrical resistance state is referred to as the on-state of the non-linear material. The details of the tunneling process and the effects of increasing voltages on the potential barriers to conduction are well described by the quantum-mechanical theory of matter at the atomic level. Because the nature of the conduction is primarily quantum mechanical tunneling, the time response of the material to a fast rising voltage pulse is very quick. The transition from the off-state resistivity to the on-state resistivity takes place in the nano-second to sub-nanosecond regime.

Figure 3:
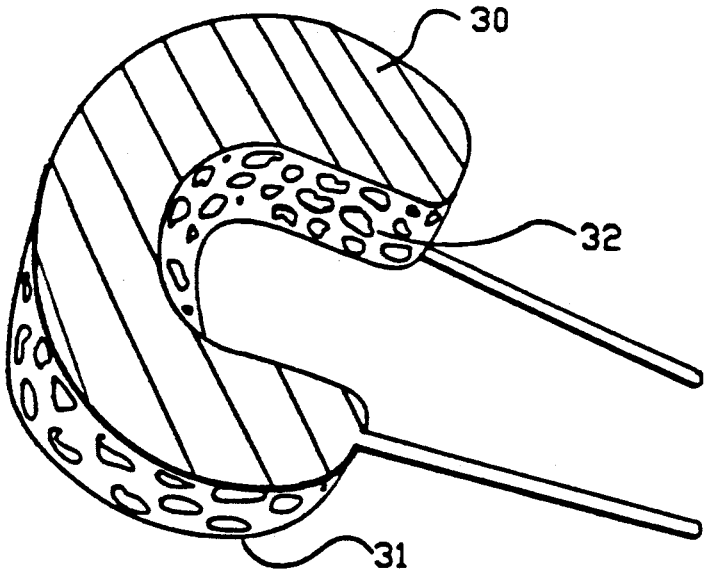
FIG. 3 is a typical device embodiment using the materials of the invention.

A typical device embodiment using the materials of the invention is shown in FIG. 3. The particular design in FIG. 3 is tailored to protect an electronic capacitor in printed circuit board applications. The material of this invention 32, to be presently described, is molded between two parallel planar leaded copper electrodes 30 and 31 and encapsulated with an epoxy. For these applications, electrode spacing can be between 0.005 inches and 0.05 inches.

In the specific application of the device in FIG. 3, using a material in accordance with Example I below, a clamping voltage of 200 volts to 400 volts, an off-state resistance of approximately ten meg-ohms, measured at ten volts, and a clamp time less than five nanoseconds is required. This specification is met by molding the material between electrodes spaced at 0.01 inches. The outside diameter of the device is 0.25 inches. Other clamping voltage specifications can be met by adjusting the thickness of the material, the material formulation, or both.

EXAMPLE I

An example of the material formulation, by weight, for the particular embodiment shown in FIG. 3 is 35% polymer binder, 0.5% cross linking agent, and 64.5% conductive powder. In this formulation the binder is Silastic 35U silicone rubber, the crosslinking agent is Varox peroxide, and the conductive powder is nickel powder with 10 micron average particle size. Analysis indicates that the inter-particle spacing for this material is in the range of 50 to 350 angstroms. Table I shows the typical electrical properties of a device made from this material formulation. This formulation provides an electrical resistance in the off-state suitable for bleeding off electrostatic charge.

TABLE I

| | |
|---|---|
| Clamp Voltage Range | 200–400 volts |
| Electrical Resistance in off-state (at 10 volts) | $1 \times 10^7$ ohms |
| Electrical Resistance in on-state | 20 ohms |
| Response (turn-on) time | <5 nano-second |
| Capacitance | <5 pico-farads |

EXAMPLE II

A second example of the material formulation, by weight, is 35% polymer binder, 1% cross linking agent, and 64% conductive powder. In this formulation the binder is Silastic 35U silicone rubber, the crosslinking agent is Varox peroxide, and the conductive powder is nickel powder with 10 micron average particle size. Table II shows the typical electrical properties of a device made from this material formulation. This formulation provides a very high electrical resistance in the off-state, typically on the order of $10^9$ ohms or higher.

TABLE II

| | |
|---|---|
| Clamp Voltage Range | 200–400 volts |
| Electrical Resistance in off-state (at 10 volts) | $5 \times 10^9$ ohms |
| Electrical Resistance in on-state | 15 ohms |
| Response (turn-on) time | <5 nano-second |
| Capacitance | <5 pico-farads |

Those skilled in the art will understand that a wide range of polymer and other binders, conductive powders, formulations and materials are possible. Other conductive particles which can be blended with a binder to form the non-linear material in this invention include metal powders of aluminum, beryllium, iron, silver, platinum, lead, tin, bronze, brass, copper, bismuth, cobalt, magnesium, molybdenum, palladium, tantalum, tungsten and alloys thereof, carbides including titanium carbide, boron carbide, tungsten carbide, and tantalum carbide, powders based on carbon including carbon black and graphite, as well as metal nitrides and metal borides. Insulating binders can include but are not limited to organic polymers such as polyethylene, polypropylene, polyvinyl chloride, natural rubbers, urethanes, and epoxies, silicone rubbers, fluoropolymers, and polymer blends and alloys. Other insulating binders include ceramics, refractory materials, waxes, oils, and glasses. The primary function of the binder is to establish and maintain the inter-particle spacing of the conducting particles in order to ensure the proper quantum mechanical tunneling behavior during application of an electrical over-voltage situation.

The binder, while substantially an insulator, can be tailored as to its resistivity by adding to it or mixing with it various materials to alter its electrical properties. Such materials include powdered varistors, organic semiconductors, coupling agents, and antistatic agents.

Figure 4:
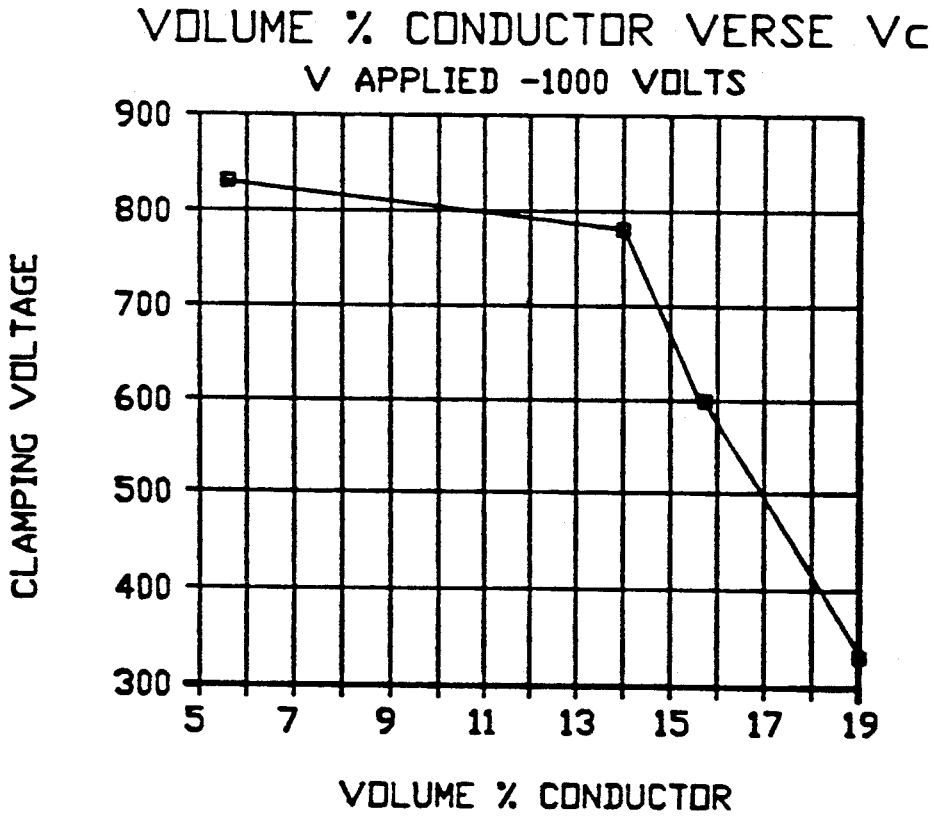
FIG. 4 is a graph of the clamp voltage versus volume percent conductive particles.

A wide range of formulations can be prepared following the above guidelines to provide materials with various inter-particle spacings which give clamping voltages from fifty volts to fifteen thousand volts. The inter-particle spacing is determined by the particle size and volume percent loading. The device thickness and geometry also govern the final clamping voltage. As an example of this, FIG. 4 shows the Clamping Voltage $V_c$ as a function of Volume Percent Conductor for materials of the same thickness and geometry, and prepared by the same mixing techniques. The on-state resistance of the devices tested for FIG. 4 are typically in the range of under 100 ohms, depending on the magnitude of the incoming voltage transient.

Figure 5:
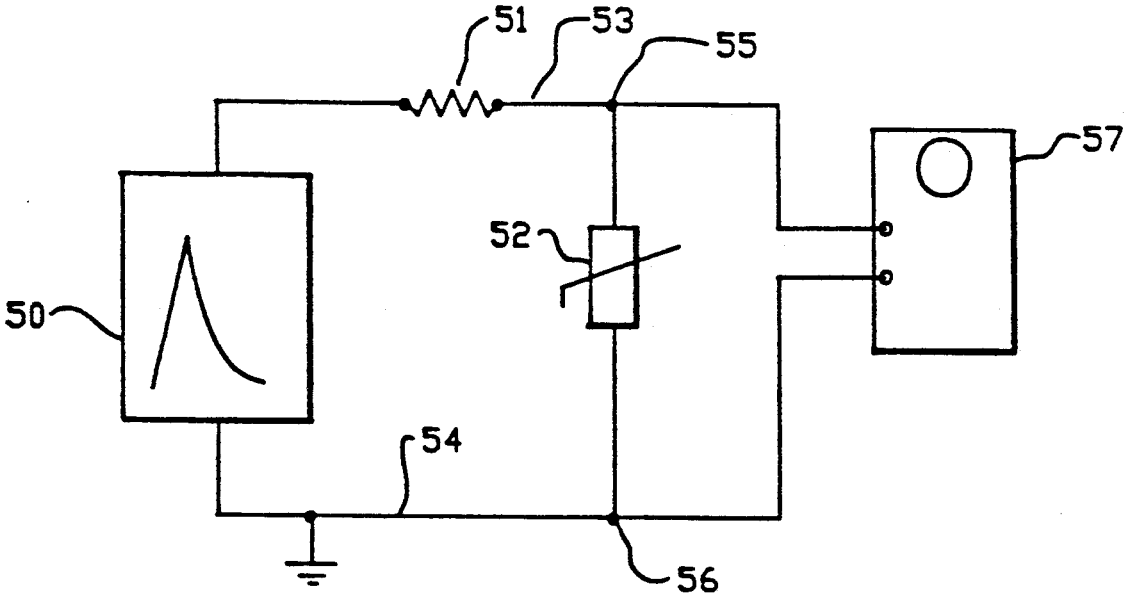
FIG. 5 is a typical test setup for measuring the over-voltage response of devices made from the invention.

FIG. 5 shows a test circuit for measuring the electrical response of a device made with materials of the present invention. A fast rise-time pulse, typically one to five nanosecond rise time, is produced by pulse generator 50. The output impedance 51 of the pulse generator is fifty ohms. The pulse is applied to non-linear device under test 52 which is connected between the high voltage line 53 and the system ground 54. The voltage versus time characteristics of the non-linear device are measured at points 55 and 56 with a high speed storage oscilloscope 57.

Figure 6:
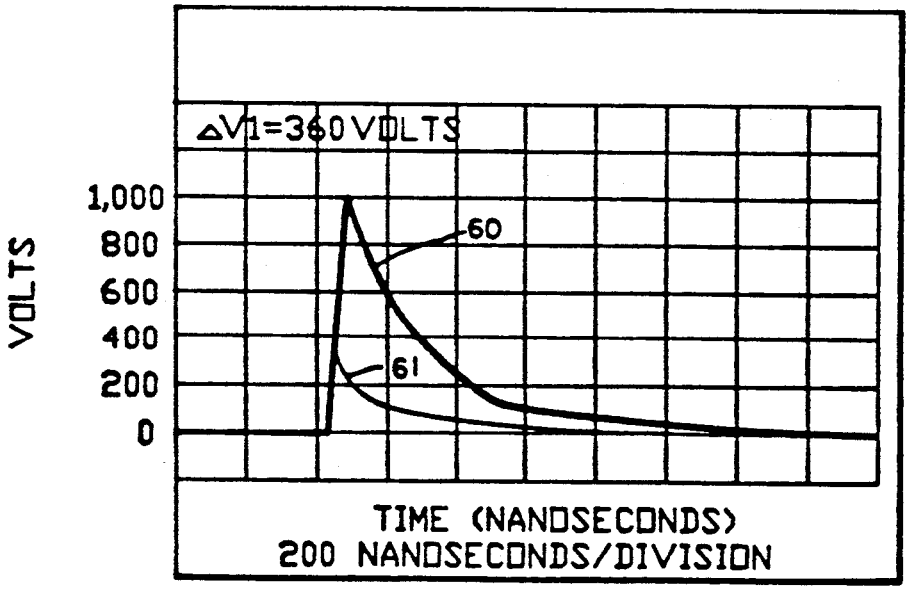
FIG. 6 is a graph of voltage versus time for a transient over-voltage pulse applied to a device made from the present invention.

The typical electrical response of a device formed with the material of Example I and tested with the circuit in FIG. 5 is shown in FIG. 6 as a graph of voltage versus time for a transient over-voltage pulse applied to the device. In FIG. 6 the input pulse 60 has a rise time of five nanoseconds and a voltage amplitude of one thousand volts. The device response 61 shows a clamping voltage of 336 volts in this particular example. The off-state resistance, measured at 10 volts, of the device tested in FIG. 6 is $1.2\times10^7$ ohms, in the desired range for applications requiring electrostatic bleed. The on-state resistance of the device tested in FIG. 6, in its non-linear resistance region, is approximately 20 ohms to 30 ohms.

Figure 7:
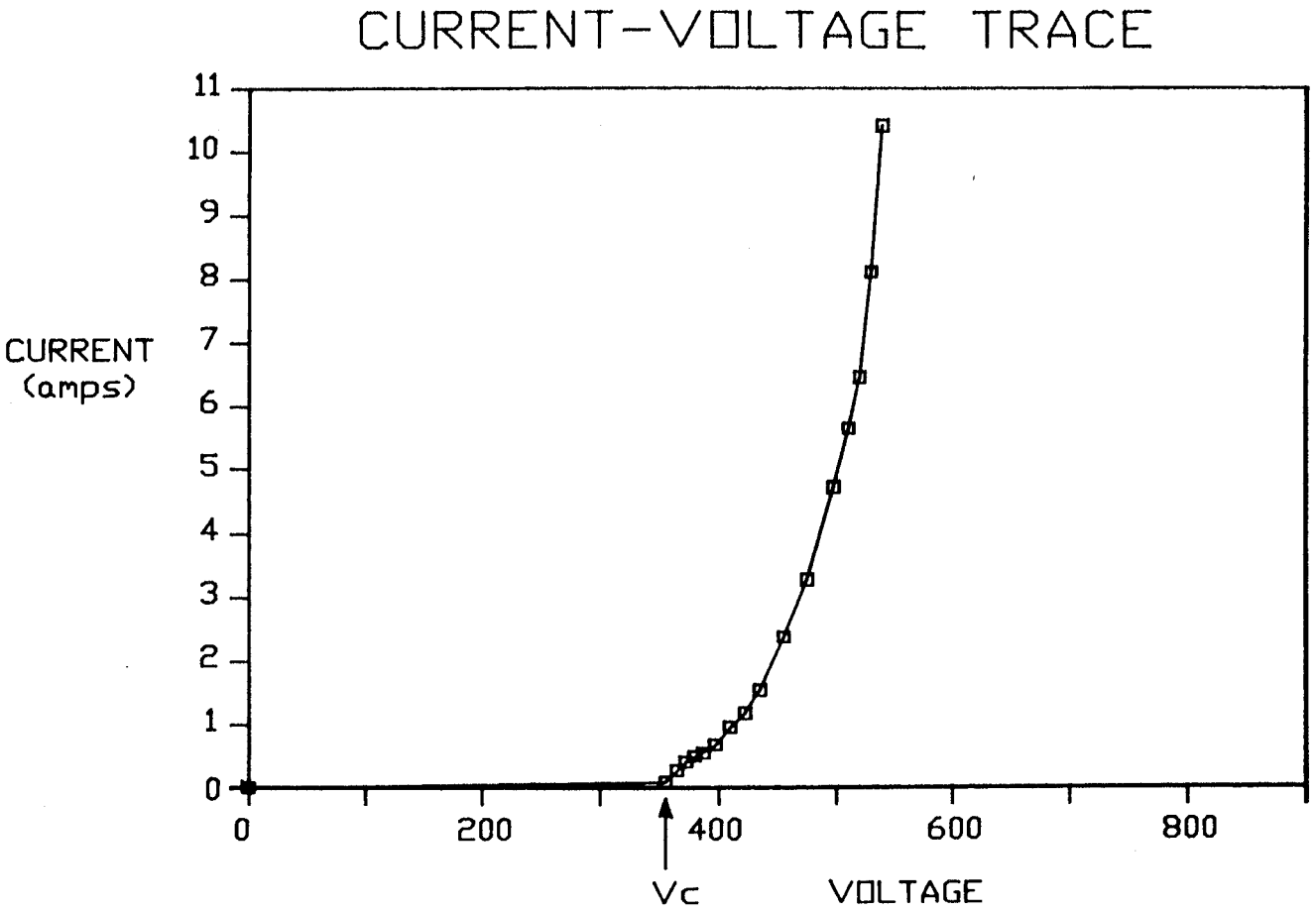
FIG. 7 is a graph of current versus voltage for a device made from the present invention.

The current-voltage characteristics of a device made from the present invention are shown in FIG. 7 over a wide voltage range. This curve is typical of a device made from materials from either Example I or Example II. The highly non-linear nature of the material and device is readily apparent from FIG. 7. The voltage level labeled $V_c$ is referred to variously as the threshold voltage, the transition voltage, or the clamping voltage. Below this voltage $V_c$, the resistance is constant, or ohmic, and very high, typically 10 meg-ohms for applications requiring electrostatic bleed, and $10^9$ ohms or more for applications not requiring electrostatic bleed. Above the threshold voltage $V_c$ the resistance is extremely voltage dependent, or non-linear, and can be as low as approximately 10 ohms to 30 ohms for devices made from the present invention. It is obvious from FIG. 7 that even lower resistance values, of the order of 1 ohm or less, can be obtained by applying higher input voltages to the device.

Processes of fabricating the material of this invention include standard polymer processing techniques and equipment. A preferred process utilizes a two roll rubber mill for incorporating the conductive particles into the binder material. The polymer material is banded on the mill, the crosslinking agent if required is added, and the conductive particles added slowly to the binder. After complete mixing of the conductive particles into the binder the blended is sheeted off the mill rolls. Other polymer processing techniques can be utilized including Banbury mixing, extruder mixing and other similar mixing equipment. Material of desired thickness is molded between electrodes. Further packaging for environmental protection can be utilized if required.

I claim:

1. An overvoltage protection material for placement between and in contact with spaced conductors, said material comprising a matrix formed of a binder and only closely spaced conductive particles:

a) said only closely spaced conductive particles homogeneously distributed in said binder, said particles being in the size range 10 microns to two hundred microns and spaced in the range 25 angstroms to 350 angstroms to provide electrical conduction by quantum-mechanical tunneling therebetween; and b) said binder selected to provide the quantum-mechanical tunneling media between said particles and predetermined resistance between said conductive particles in the absence of quantum-mechanical tunneling.

2. A material according to claim 1 wherein the binder is an electrical insulator.

3. A material according to claim 1 wherein the binder material has electrical resistivity ranging from $10^8$ to about $10^{16}$ ohm-centimeters.

4. A material according to claim 1 wherein the binder is a polymer which has had its resistance characteristics modified by addition of materials such as powdered metallic compounds, powdered metallic oxides, powdered semiconductors, organic semiconductors, organic salts, coupling agents, and dopants.

5. A material according to claim 1 wherein the binder is selected from the class of organic polymers such as polyethylene, polypropylene, polyvinyl chloride, natural rubbers, urethanes, and epoxies.

6. A material according to claim 1 wherein the binder is selected from silicone rubbers, fluoropolymers, and polymer blends and alloys.

7. A material according to claim 1 wherein the binder is selected from the class of materials including ceramics, and refractory alloys.

8. A material according to claim 1 wherein the binder is selected from the class of materials including waxes and oils.

9. A material according to claim 1 wherein the binder is selected from the class of materials including glasses.

10. A material according to claim 1 wherein the binder includes fumed silicon dioxide, quartz, alumina, aluminum trihydrate, feld spar, silica, barium sulphate, barium titanate, calcium carbonate, woodflour, crystalline silica, talc, mica, or calcium sulphate.

11. A material according to claim 1 wherein the conductive particles include powders of aluminum, beryllium, iron, gold, silver, platinum, lead, tin, bronze, brass, copper, bismuth, cobalt, magnesium, molybdenum, palladium, tantalum, tungsten and alloys thereof, carbides including titanium carbide, boron carbide, tungsten carbide, and tantalum carbide, powders based on carbon including carbon black and graphite, as well as metal nitrides and metal borides.

12. A material according to claim 1 wherein the conductive particles include uniformly sized hollow or solid glass spheres coated with a conductor such as include powders of aluminum, beryllium, iron, gold, silver, platinum, lead, tin, bronze, brass, copper, bismuth, cobalt, magnesium, molybdenum, palladium, tantalum, tungsten and alloys thereof, carbides including titanium carbide, boron carbide, tungsten carbide, and tantalum carbide, powders based on carbon including carbon black and graphite, as well as metal nitrides and metal borides.

13. A material according to claim 1 wherein the conductive particles have resistivities ranging from about $10^{-1}$ to $10^{-6}$ ohm-centimeters.

14. A material according to claim 1 wherein the percentage, by volume, of conductive particles in the material is greater than about 0.5% and less than about 50%.

15. A two terminal device utilizing materials in any one of claims 1 through 14 to provide nanosecond transient over-voltage protection to electronic circuitry between terminals.

16. An electroded device utilizing materials in any one of claims 1 through 14 to provide nanosecond transient over-voltage protection to electronic circuitry.

17. A leaded electroded device utilizing materials in any one of claims 1 through 14 to provide nanosecond transient over-voltage protection to electronic circuitry.

18. A device utilizing materials in any one of claims 1 through 14 to provide nanosecond transient over-voltage protection to electronic circuitry and electrostatic bleed.

19. An electroded device utilizing materials in any one of claims 1 through 14 to provide nanosecond transient over-voltage protection to electronic circuitry and electrostatic bleed.

20. A leaded electroded device utilizing materials in any one of claims 1 through 14 to provide nanosecond transient over-voltage protection to electronic circuitry and electrostatic bleed.

21. A device utilizing materials in any one of claims 1 through 14 in which the on-state resistance is low, on the order of 10 ohms.

* * * * *